US005535537A

United States Patent [19]

Avganim

[11] Patent Number: 5,535,537

[45] Date of Patent: Jul. 16, 1996

[54] FIREARM SAFEGUARD DEVICE

[76] Inventor: Meir Avganim, 156 Moshav, Gealiya, Israel

[21] Appl. No.: 515,162

[22] Filed: Aug. 15, 1995

[30] Foreign Application Priority Data

Aug. 19, 1994 [IL] Israel ..... 110719
Mar. 6, 1995 [IL] Israel ..... 112884

[51] Int. Cl.[6] ..... F41A 17/54

[52] U.S. Cl. ..... 42/70.07; 42/70.11

[58] Field of Search ..... 42/70.06, 70.07, 42/70.11

[56] References Cited

U.S. PATENT DOCUMENTS

| | | | |
|---|---|---|---|
| 3,392,471 | 7/1968 | Foote | 42/70.07 |
| 3,664,163 | 5/1972 | Foote | 248/203 |
| 3,939,679 | 2/1976 | Barker et al. | 70/277 |
| 4,198,026 | 4/1980 | Capolupo | 248/552 |
| 4,328,687 | 5/1982 | Ritchie | 70/34 |
| 4,509,281 | 4/1985 | Dreiling et al. | 42/70.07 |
| 5,153,360 | 10/1992 | Upton | 42/70.11 |
| 5,271,174 | 12/1993 | Bentley | 42/70.11 |
| 5,392,552 | 2/1995 | McCarthy et al. | 42/70.07 |
| 5,437,119 | 9/1995 | Womack | 42/70.07 |

*Primary Examiner*—Stephen M. Johnson
*Attorney, Agent, or Firm*—Ostrolenk, Faber, Gerb & Soffen

[57] ABSTRACT

Firearm safeguard device of the type comprising a pair of mating blocking members adapted to be locked to each other within the trigger-guard. In one embodiment the device is mountable on a wall, preferably with a barrel support bracket. Release of the device can be electrically actuated. In another embodiment, a steel cable is attached, clamped between the blocking members at one end and secured to the wall at its other end.

10 Claims, 5 Drawing Sheets

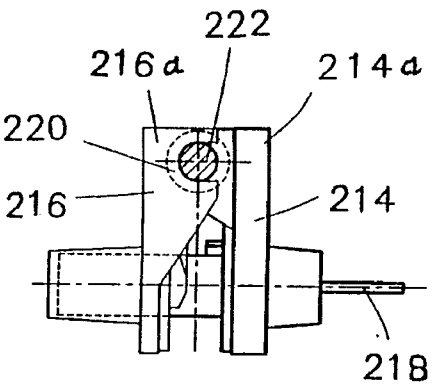
FIG. 11
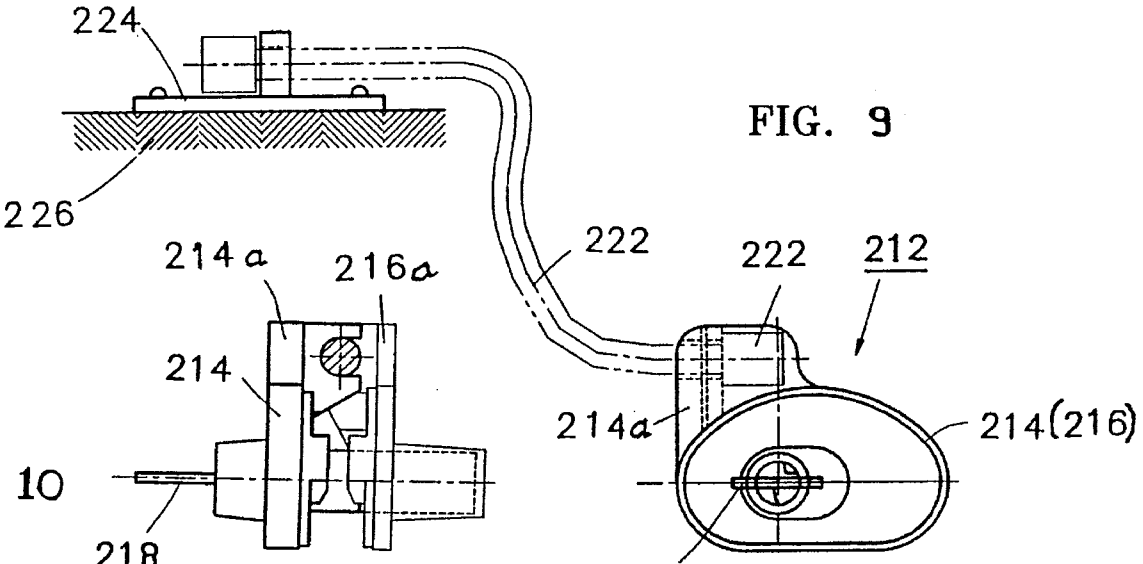
FIG. 9
FIG. 10
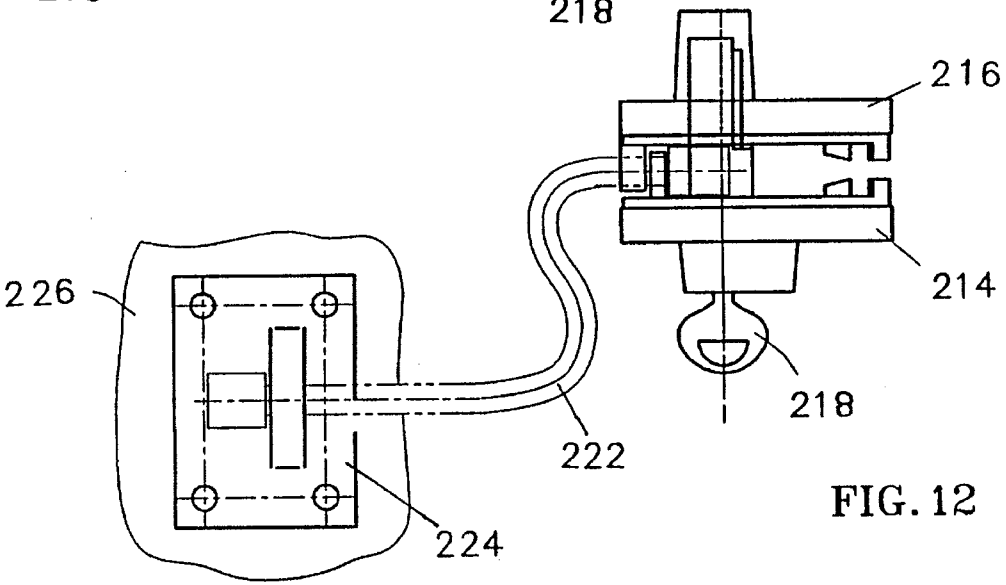
FIG. 12

FIREARM SAFEGUARD DEVICE

BACKGROUND OF THE INVENTION

The present invention relates to firearms and more specifically to safety devices against unauthorized use thereof.

Firearm safety devices are known, comprising a pair of complementary, key-operated blocking members adapted to be assembled inside the trigger guard, and when locked prevent the insertion of the finger into the trigger guard or otherwise operating the trigger.

While these devices satisfactorily fulfill their task, and are widely used, they do not offer a solution to the problem of the firearm being stolen and taken away, a matter which is considered gross negligence on the part of the owner.

The invention aims to provide safeguard means effective for both the actuation and mobilization of trigger-operated firearms.

SUMMARY OF THE INVENTION

According to the invention there is thus provided a firearm safety device comprising first and second complementary key-operated trigger blocking members to be selectively mounted and locked to—or released from—the trigger guard of the firearm, means being provided for fastening said members to a stationary object.

In accordance with one preferred embodiment of the invention, said fastening is attained by interlocking by the blocking members one end of a cable whose other end is anchored to a stationary object.

In accordance with another preferred embodiment of the invention, one of the blocking members is affixed to the stationary object, such as a building wall or portion of a vehicle.

Preferably, an attachment member is also provided, affixed to the wall while holding a portion of the firearm's barrel.

The device may include electro-mechanical, remotely controlled means for releasing the blocking members from each other.

BRIEF DESCRIPTION OF THE DRAWINGS

These and additional features and advantages of the invention will be appreciated in view of the following detailed description of two preferred embodiments thereof with reference to the accompanying drawings, wherein FIG.

FIG. 9 is an elevation of the locking device of a FIG. 8, removed from the gun;

FIG. 10 is one side view of the device of FIG. 9;

FIG. 11 is another side view of the device of FIG. 9; and

FIG. 12 is a top view of the device of FIG. 9.

DETAILED DESCRIPTION OF THE PREFERRED EMBODIMENTS

Figure 1:
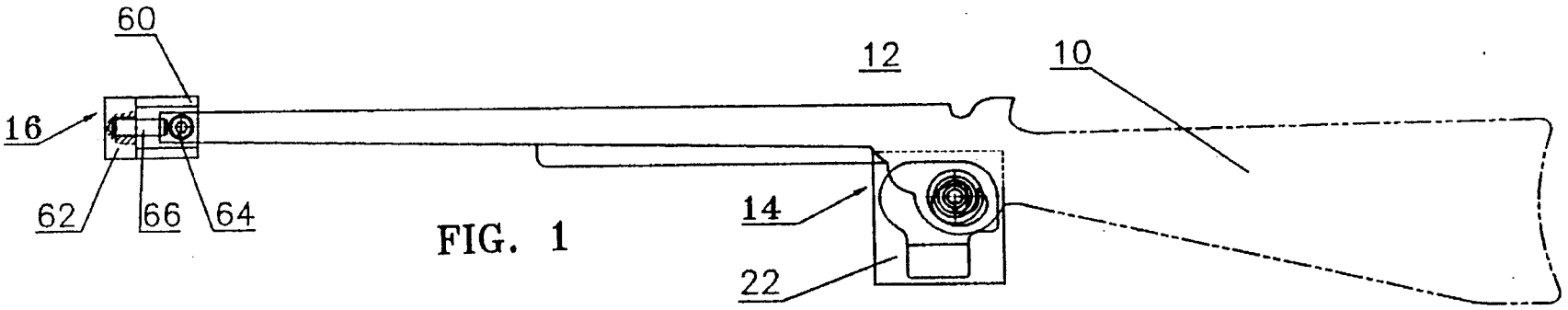
FIG. 1 is an elevation of a rifle, mounted to a wall.
Figure 2:
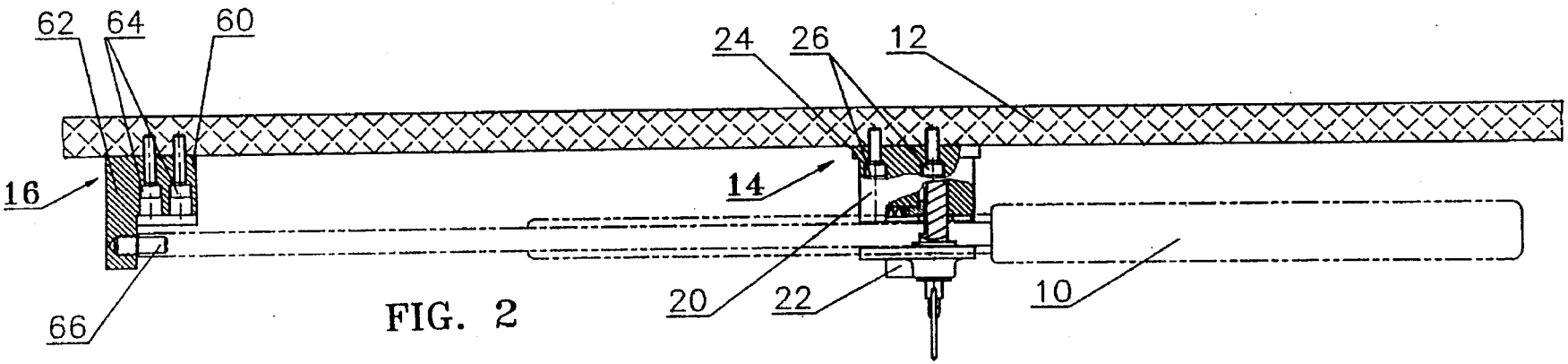
FIG. 2 is a top view of FIG. 1.

As shown in FIGS. 1 and 2, a rifle designated 10 is mounted to a wall 12, first by a lockable mounting device generally denoted 14 (details of which be given below), and also by an attachment member designated 16.

In more detail, the mounting device 14 is generally of the conventional, key-operated type referred to above; however, it differs in that one of the blocking members—preferably the one not including the key-operated locking mechanism—has a flat surface with bores or other facilities, adapting same to be affixed to a building wall or other stationary objects.

Figure 4A:
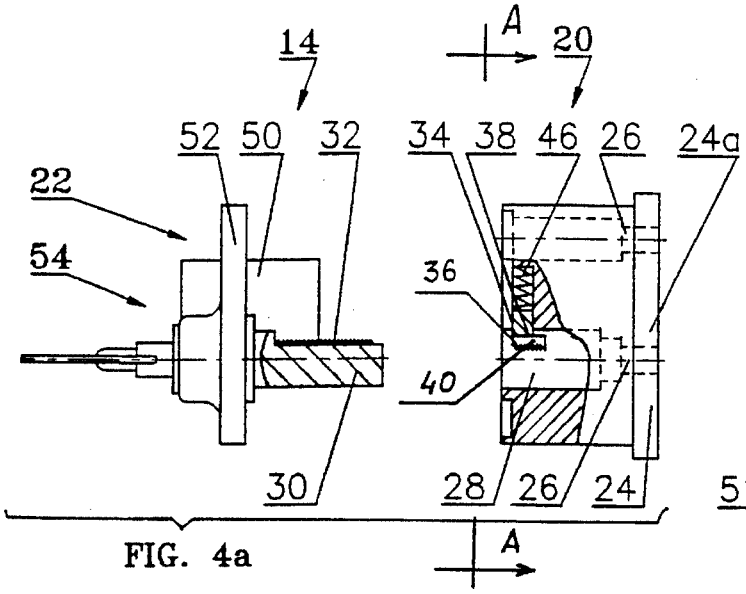
FIG. 4*a* is a partly sectional side view of the fixed and the releasable members of the device in an open, unlocked position.
Figure 4B:
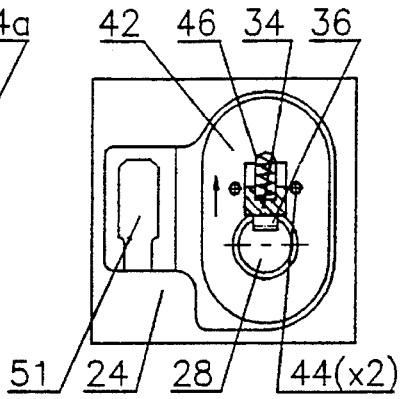
FIG. 4*b* is a view, taken along line A—A of FIG. 4*a;*

Hence, as more clearly shown in FIGS. 4*a* and 4*b*, the device 14 comprises a stationary blocking member 20 and a releasable member 22. The member 20 has a flat mounting plate 24, presenting a rear surface 24*a*, which is adapted to be attached to the wall 12 in case of home use, or to the floor or an upright member of a vehicle, e.g. when applied to police patrol car use. The mounting to the wall is completed in the exemplified embodiment by bolts 26 as shown in FIG. 2.

The member 20 further comprises a cylindrical cavity 28, configured to receive a spindle 30 provided with a series of ratchet like teeth 32, associated with the releasable blocking member 22. The teeth 32 cooperate with a slidably mounted catch member 34 in the form of a plate having counter-teeth 36 at its end which projects into the cavity 28, and a tail portion 38 that are seated within a cavity 40, closed by a plate 42. e.g. by a pair of screws 44. The catch plate 38 is loaded by a spring 46 in the direction of the cavity 28.

Figure 5A:
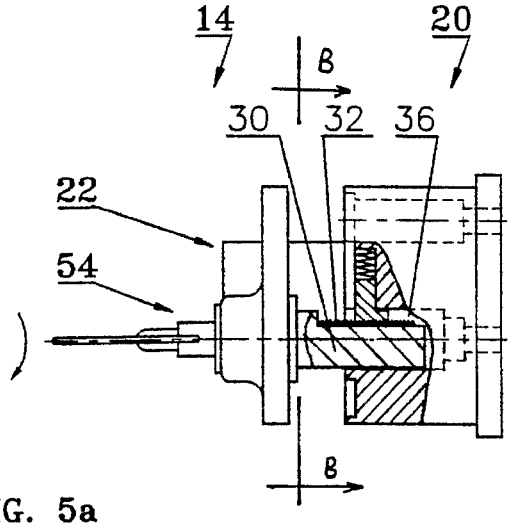
FIG. 5*a* shows the members of FIG. 4*a* in the locked position.
Figure 5B:
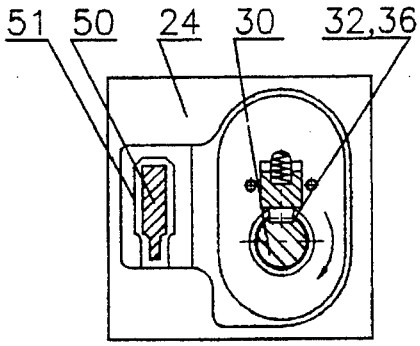
FIG. 5*b* is a sectional view taken along line B—B of FIG. 5*a;*

It will be now readily understood that the member 22 is attachable to the member 20 by inserting the spindle 30 into the cavity 28, while the teeth 32 and 36 allow such movement in this direction, as more clearly shown in FIG. 5*a*.

Figure 6A:
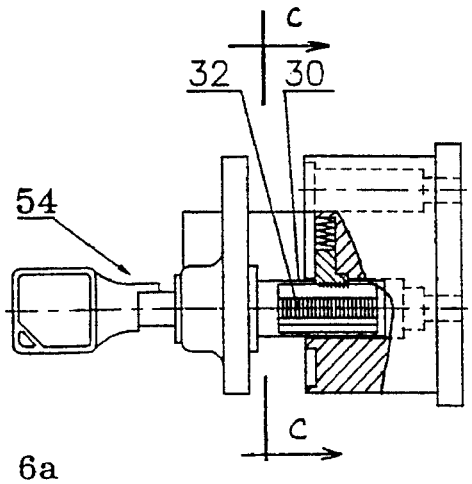
FIG. 6*a* illustrates the unlocking of the device of FIG. 5*a;*
Figure 6B:
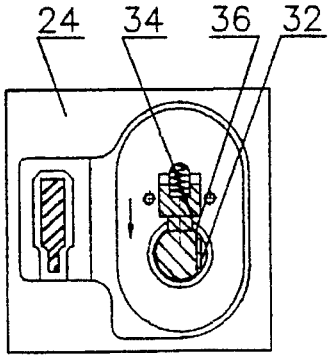
FIG. 6*b* is a sectional view taken along line C—C of FIG. 6*a;*

The member 22 further comprises a guiding projection 50 adapted to slide into complementary cavity 51, a counter firearm trigger-guard holding plate 52, and a key mechanism with a key, generally denoted 54. In the locking position of the key, namely when the teeth 32 are directed upwards, the insertion of the spindle 30 causes the locking catch 34 to run and click over the teeth 32, however retrieving or withdrawal of the spindle 30 (and of the releasable member 22) is prevented due the engagement of the teeth 32 and 36. In order to release the member 22 from the member 20, rotation of the spindle 30 by the key by 90 degrees must first be effected (FIG. 6*a*) to allow the disengagement of the teeth 36 from the teeth 32, i.e., after the catch member 34 rests against a smooth surface of the spindle 30.

Referring back to FIGS. 1 and 2, it is shown that the attachment member 16 is generally L-shaped, namely comprising a first leg 60 and a second leg 62. In the leg 60 there are provided a pair of bores for the insertion of wall mounting screws 64 as seen in FIG. 2. The leg 62 is provided with a projecting boss or pin 66 of a diameter less than the caliber of the rifle 10 so that it can be freely inserted thereinto.

The addition of the attachment member 16 is important, in order to avoid the forceful removal of the device 14 from the wall by twisting the rifle.

From the forgoing description, the mounting and dismounting of the firearm from the wall is now self-evident and need not be further described.

Figure 3:
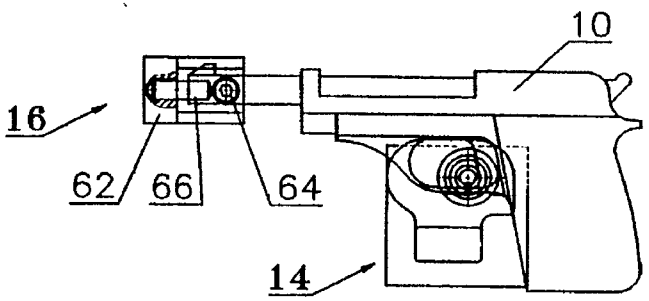
FIG. 3 illustrates the application of the device of FIGS. 1 and 2 for fastening of a pistol.

FIG. 3 illustrates a pistol mounting by the same device 16 and barrel support 16, and therefore need not to be further described.

According to a further development, the arrangement of FIG. 7 will now be explained. It is well known that when under pressure of time should the weapon be needed in urgency, e.g. for self-defense, one can panic and fail to find the key and/or to complete the unlocking of the device; and then it might be too late to use the firearm.

Another case which calls for quick and easy manipulation of the locking device are policemen who must lock or otherwise safeguard their rifles in the patrol cars frequently, namely every time they get out of the car.

Figure 7:
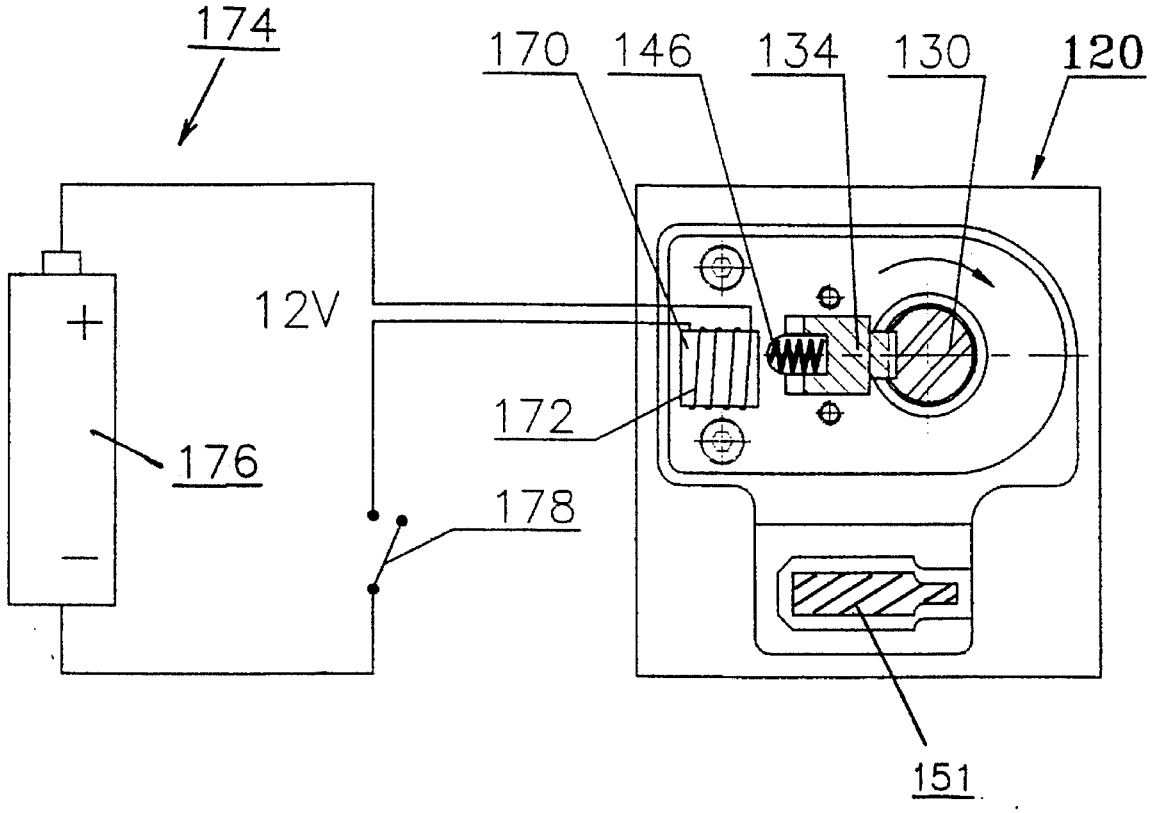
FIG. 7 schematically illustrates the control of the unlocking of device by electro-mechanical means according to a preferred embodiment of the invention.
Figure 8:
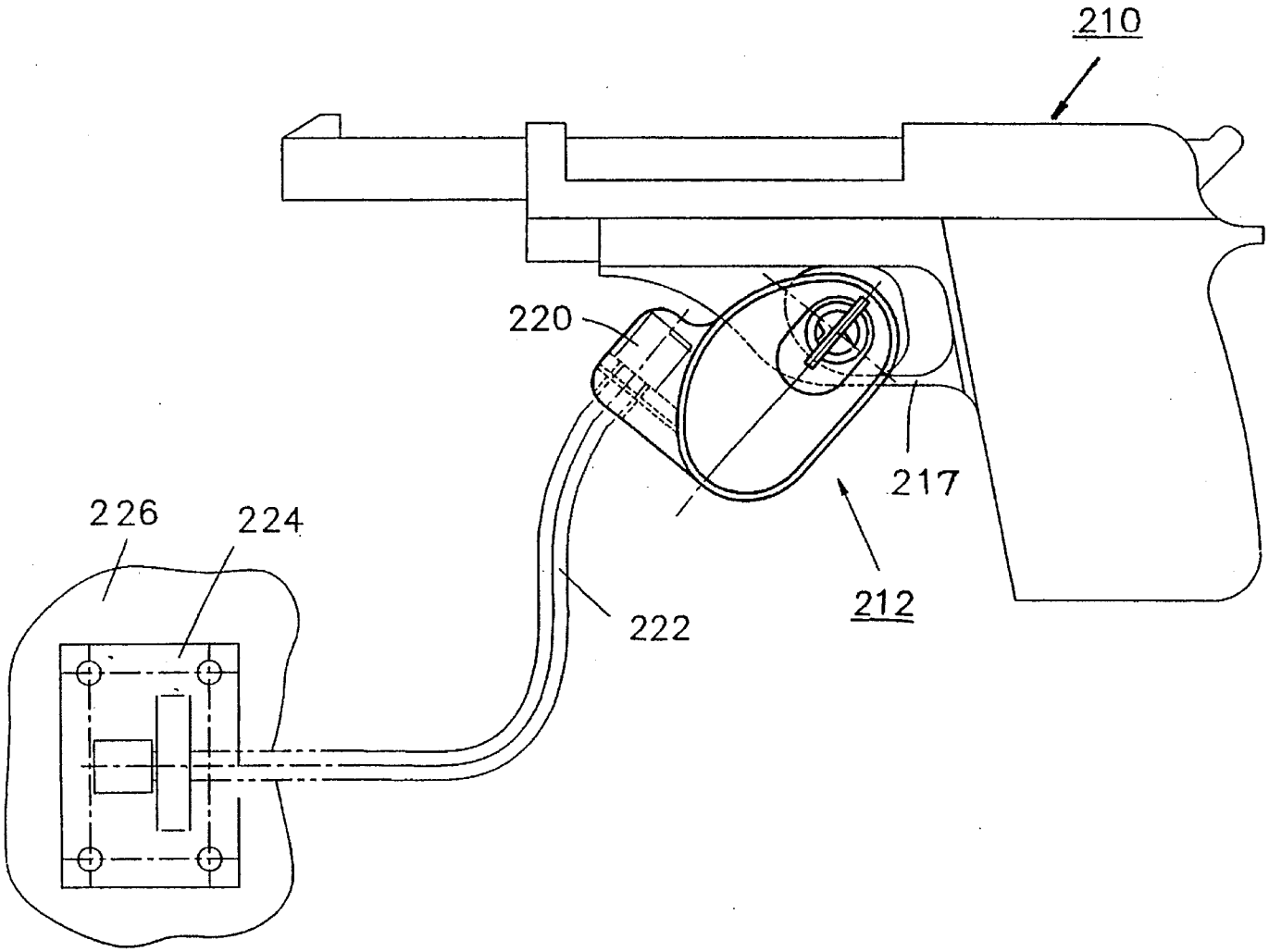
FIG. 8 illustrates the trigger safety device incorporating a cable as means for fastening same to a wall.

To this end the arrangement of FIG. 7 is proposed. Hence, the stationary or fixed member 120 is affixed, e.g. to the car floor or to the special stand provided for that purpose, possessing essentially the same features and construction of the member 20, as described above. It thus comprises a sliding catch member 134 with spring 146 for holding a locking member spindle 130, which is key-operated in same manner as the member 22 of the preceding embodiment.

However, the arrangement is such, that there is provided an armature 170 in proximity to the catch 134. The armature 170 is wound by wire 172, forming part of an electrical circuit 174, namely comprising battery 176 and an ON-OFF switch 178, which may be constituted by the ignition switch in the vehicular application of the device.

It will be clearly understood that once the switch 178 is closed, the electro-magnetic force developed by the armature 170 will overcome the force of the spring 146 and release the catch 130 from its engagement with the spindle 134, so that the releasable member can be unlocked (not shown) without using the appropriate key.

It is believed that this arrangement will be welcomed by policemen patrolling in their vehicles since it allows them the quick, easy and convenient access to the weapons even under most extreme time pressure and panic conditions.

According to a modified embodiment of the invention shown in FIGS. 8–12, a pistol 210 has attached thereto a trigger guard safety device generally designated 212. The device may again be of the generally conventional design, namely comprising a pair of mating blocking members 214 and 216 adapted to fit inside as well as around the trigger guard 217 of the pistol 210 when locked to each other by means of a key 218.

However, unlike the conventional devices, the two members are provided each with an integrally formed extension 214*a* and 216a, respectively (FIG. 10). The extensions are partly hollow thereby allowing the accommodation therebetween of a cap 220 of safety cable 222. The cap 220 is clamped so that only upon the separation of the members 214 and 216 from each other release of the device 210 from the cable 222 can be achieved.

The other end of the cable 222 is anchored by any suitable means, such as plate 224 to a stationary object or surface such as a wall 226, chassis of a motor car and the like.

The invention thus provides, by most simple means a solution to the yet unsolved problem of guns being stolen from apartment houses, motor cars and even for the securement of a large number of rifles within an arms storehouse, which were heretofore being secured in series by a chain or cable passed through the trigger guards of all of them, therefore made the release of a rifle from the group most cumbersome and time consuming.

Those skilled in the art will readily appreciate that various changes, modification and variations may be applied to the invention as above exemplified without departing from the scope of the invention as defined in and by the appended claims.

Those skilled in the art to which the invention proteins will readily appreciate that various changes, modifications and variations may be applied to the invention as heretofore exemplified without departing from its scope as defined in and by the appended claims.

What is claimed is:

1. A firearm safety device for a firearm including a trigger and a trigger guard over the trigger, the device comprising first and second complementary key-operated trigger blocking members to be selectively either mounted and locked to or released from the trigger guard of the firearm, wherein one of the blocking members is adapted to be affixed to a stationary object means for fastening the one member to the stationary object;

a key-operated rotatable cylinder installed in the other, releasable one of the blocking members; a reciprocal spring-loaded catch member cooperating with the cylinder to lock the other blocking member to and to unlock the other blocking member from the one blocking member by rotation of the cylinder;

an electro-mechanical, remotely controlled device for releasing the blocking members from each other, an armature of the electro-mechanical device being associated with the catch member; and means for remotely actuating the electro-mechanical device.

2. The device as claimed in claim 1, wherein the said stationary object is a building wall.

3. The device as claimed in claim 2, wherein the firearm includes a barrel, the device further comprising an attachment member affixed to the wall for holding a portion of the firearm barrel.

4. The device as claimed in claim 3, wherein the attachment member comprises a boss freely insertable into the mouth of the barrel.

5. The device as claimed in claim 4, wherein the attachment member is in the form of a bracket, and the boss extending parallel to the said wall.

6. The device as claimed in claim 1 wherein the electro-mechanical device is battery operated.

7. The device as claimed in claim 6, wherein the said battery operation is via the vehicle's battery.

8. The device as claimed in claim 1, wherein the stationary object is a portion of a vehicle.

9. The device as claimed in claim 1 wherein said fastening means include a cable whose one end is interlocked by the members and its other end is anchored to the stationary object.

10. The device as claimed in claim 9 wherein said one end of the cable is capped, at least one of said blocking member is formed with a cavity configured to accommodated the capped end, arresting same when the members are in their locked state.

* * * * *